US010214348B2

(12) United States Patent
Andro-Vasko

(10) Patent No.: US 10,214,348 B2
(45) Date of Patent: Feb. 26, 2019

(54) AIR-VENTILATED TRASH CONTAINER SYSTEM

(71) Applicant: Sandor Andro-Vasko, Las Vegas, NV (US)

(72) Inventor: Sandor Andro-Vasko, Las Vegas, NV (US)

( * ) Notice: Subject to any disclaimer, the term of this patent is extended or adjusted under 35 U.S.C. 154(b) by 99 days.

(21) Appl. No.: 15/266,675

(22) Filed: Sep. 15, 2016

(65) Prior Publication Data

US 2017/0259994 A1 Sep. 14, 2017

Related U.S. Application Data

(60) Provisional application No. 62/307,335, filed on Mar. 11, 2016.

(51) Int. Cl.
*B65F 1/06* (2006.01)
*B65F 1/16* (2006.01)

(52) U.S. Cl.
CPC ..... *B65F 1/068* (2013.01); *B65F 1/067* (2013.01); *B65F 1/16* (2013.01); *B65F 2210/1815* (2013.01)

(58) Field of Classification Search
CPC ..... B65F 2210/179; B65F 1/06; B65F 2210/181; Y10T 24/4406
USPC ..... 220/908.1
See application file for complete search history.

(56) References Cited

U.S. PATENT DOCUMENTS

| | | | | |
|---|---|---|---|---|
| 4,715,572 | A | 12/1987 | Robbins, III et al. | |
| 5,375,732 | A | 12/1994 | Bowers et al. | |
| 6,000,571 | A * | 12/1999 | Brooks | B65F 1/06 220/495.04 |
| 6,223,927 | B1 * | 5/2001 | Rand | B65F 1/06 220/495.06 |
| 6,474,495 | B1 * | 11/2002 | Frei | B65F 1/06 220/495.08 |
| 7,438,199 | B1 * | 10/2008 | Tidrick | B65F 1/06 220/495.04 |
| 7,635,065 | B1 * | 12/2009 | Pettinger | B65F 1/068 220/495.04 |
| 7,888,168 | B2 * | 2/2011 | Weidman | H01L 31/022425 257/E21.246 |
| 2012/0065570 | A1 | 3/2010 | Smith | |
| 2012/0217242 | A1 | 8/2012 | Dyer et al. | |

* cited by examiner

*Primary Examiner* — Shawn M Braden
(74) *Attorney, Agent, or Firm* — Connie R. Masters

(57) ABSTRACT

An air-ventilated trash container suitable for supporting a collapsible trash bag having an open-top hollow container body that includes an integrated sidewall joined to a closed bottom is provided. The integrated sidewall includes an upright inner sidewall configured with a plurality of upper air release orifices and a plurality of laterally spaced apart, generally vertical ribs disposed extending outwardly from the inner sidewall. The ribs define between themselves a plurality of narrow channels that extend longitudinally to provide a passage during bag installation for the escape of air trapped between the inner sidewall, during bag filling to allow the bag to fully expand, and during bag removal to prevent the formation of a vacuum that would tend to cause the retention of the bag inside the container.

7 Claims, 13 Drawing Sheets

AIR-VENTILATED TRASH CONTAINER SYSTEM

CROSS-REFERENCE TO RELATED APPLICATIONS

This nonprovisional application claims the benefit of U.S. Provisional Patent Application No. 62/307,335, filed on Mar. 11, 2016, which is incorporated herein in its entirety.

FIELD OF INVENTION

This invention relates generally to a trash container for supporting any one of a variety of collapsible trash bags and, more particularly, to an air-ventilated trash container system having an open-top hollow container body with a bottom wall and integrated sidewall, with the integrated sidewall including a primary inner wall portion with a plurality of ventilation orifices and vertical ribs.

BACKGROUND

When a collapsible trash bag is placed into a trash container of a corresponding size, the top of the trash bag is held securely at the lip of the trash container. However, this proper positioning causes air to be trapped between the trash bag and the sides of the container, making it difficult to install the bag and reducing the effective volume of trash that can be accommodated within the inner trash bag, i.e., the volume within the installed trash bag is less than the volume of the trash container. Consequently, more trash bags than necessary are needed to hold the volume of trash potentially accommodated by the trash container, and the partially full bags necessitate more trips to empty the trash than would be needed if the bags of trash were at full volume. Additionally, upon removal of the properly positioned trash bag, a vacuum tends to be created between the trash bag and the inner wall of the trash container.

Several types of trash containers have been developed that reduce this trapped air or vacuum situation by providing some type of air ventilation.

One type of ventilated trash container has sidewalls that are fully formed of mesh. The mesh sides allow air to move freely from the interior to the exterior and vice versa, but these mesh sides do not provide any containment of the trash should the interior trash bag leak or burst.

Another type of air ventilated trash container employs one or more interior or exterior hollow tubes with a lower end open to the trapped air at the bottom of the trash container and with an upper end that allows air to escape to the atmosphere on the exterior of the trash container. However, this tube-type trash container has disadvantages. The tubes are often fabricated separately and attached in place, which increases production costs. Either interior or exterior tubes are likely to interfere with the containers being stacked or nested efficiently, and less efficient stacking increases the cost for shipping, storage and retail shelf space. If the hollow tubes are on the exterior of the trash container, they cause the exterior to be irregular and unattractive. If the hollow tubes are in the interior of the trash container, the irregularities caused by the hollow tubes can collect dirt and can be difficult to clean.

A further type of ventilated trash container, described in U.S. Pat. No. 5,170,906 to Kochelek, employs sidewalls with ribs extending inwardly from the interior surface of the sidewall to form open U-shaped structures. The trash bag rests against the U-shaped structures and cooperates with them to form vertical channels allowing air trapped at the bottom of the trash container to escape to the top or air to flow in to prevent the formation of a vacuum. Though the channels may serve to provide ventilation, the irregular and convoluted interior surface is adjacent to the trash being deposited and will soil easily, particularly if a trash bag leaks, and will be difficult to clean. Additionally, the projecting U-shaped structures reduce the volume of the trash container.

Another type of ventilated trash container has sidewalls that are vertically pleated. The pleats may be only internal waves or pleats, similar to the Kochelek trash container, but more often the pleats are integrally formed within the sidewall giving both the inside and outside a wavy or pleated configuration. The interior pleats serve to form interior vertical channels, which may permit conduction of air between the sidewall and the trash bag inserted into the trash container. However, the pleats tend to reduce the stacking ability of this type of trash container, thus increasing transportation, storage, and display costs. Plus, the irregular inside and outside surfaces are not conducive to easy cleaning.

Consequently, there is a need for an air-ventilated trash container that is economical to fabricate as a single, unitary piece; that does not have interior liner-tearing projections, but has a smooth, easy-cleaning interior surface; that conceals the ventilation holes to provide a trim exterior appearance; that works well with currently available sizes of trash bags; and that maximizes the volume of trash that can be placed within the trash container.

BRIEF SUMMARY OF THE INVENTION

The present invention is directed to an air-ventilated trash container system including an open-top hollow container body that accommodates and supports a removable, disposable collapsible trash bag. The present invention further provides variations in the trash bags to be used with the air-ventilated trash container system. The open-top hollow container body includes at least a bottom wall and a continuous integrated sidewall that encircles the sides of the container body. The integrated sidewall is attached to, and preferably formed integrally with, the bottom wall. Optionally, a lid may be attached to the top of the container body.

The integrated sidewall includes an upright, generally vertical primary inner sidewall configured with a plurality of upper air release orifices and a plurality of laterally spaced apart, generally vertical outwardly-extending ribs disposed on the exterior of the inner sidewall. In the preferred first embodiment, the integrated sidewall also includes an upper, outer partial sidewall with the ribs disposed between the inner sidewall and the outer partial sidewall. The ribs define between themselves a plurality of narrow channels that extend longitudinally to provide a passage for the escape of air trapped between the inner sidewall and the bag during filling of the bag to allow the bag to fully expand and to provide a passage for the introduction of air between the inner sidewall and the bag during the removal of the bag from the container to prevent the formation of a vacuum, which would tend to cause the retention of the bag inside the container.

In one aspect of the invention, the integrated sidewall comprises an inner sidewall configured with upper air release orifices, an upper, outer partial sidewall, and laterally spaced vertical ribs disposed between the inner sidewall and the outer sidewall and extending outwardly from said inner sidewall.

In another aspect of the invention, the inner sidewall, outer partial sidewall, ribs, and bottom wall are formed unitarily.

In another aspect of the invention, the integrated sidewall includes a lip.

In a further aspect, the inner sidewall, outer partial sidewall, ribs, bottom wall, and lip are formed unitarily.

In a further aspect of the invention, the inner sidewall, outer partial sidewall, ribs, and said bottom wall are formed unitarily by injection molding.

In an additional aspect of the invention, the integrated sidewall comprises an inner sidewall configured with upper air release orifices and with laterally spaced vertical outwardly-extending ribs disposed on the exterior of the inner sidewall and does not include an upper, outer partial sidewall.

In yet another aspect, the inner sidewall may have a single air release orifice between each of the ribs.

In an additional aspect, the inner sidewall may have multiple air release orifices between each of the ribs.

In another aspect, one rib is disposed at each corner of the container body.

In a further aspect, an air-dispersing inner liner bag is provided for use with an outer standard trash bag, with both bags accommodated within the container body.

In another aspect, a method of using an air-dispersing inner liner bag with an outer standard trash bag that is partly full of trash is provided.

In another aspect, an external projection-type trash bag having a non-uniform exterior is provided.

In yet another aspect, a tightly-packed assemblage of multiple nested trash bags is accommodated within the container body.

An object of the present invention is to provide an air-ventilated trash container system having an open-top container body including a primary inner wall having ventilation orifices and including multiple ribs.

These and other objects, features, and advantages of the present invention will become more readily apparent from the attached drawings and from the detailed description of the preferred embodiments which follow.

BRIEF DESCRIPTION OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 6:
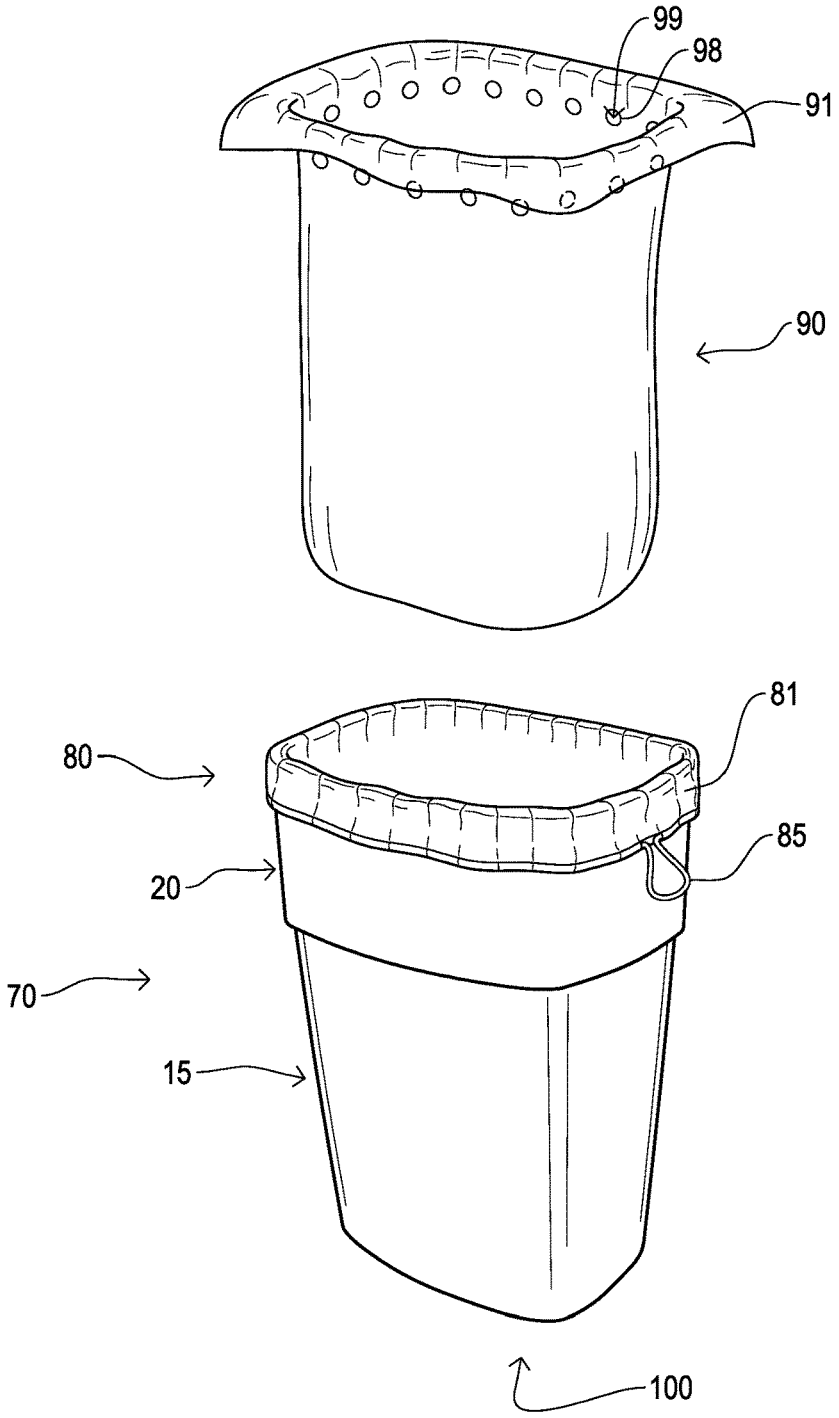
FIG. 6 is a perspective view of a third aspect of the air-ventilated trash container system of the present invention that includes an air-ventilated liner bag that is used with a primary standard trash bag and may be used with the open-top container body of the present invention.
Figure 7:
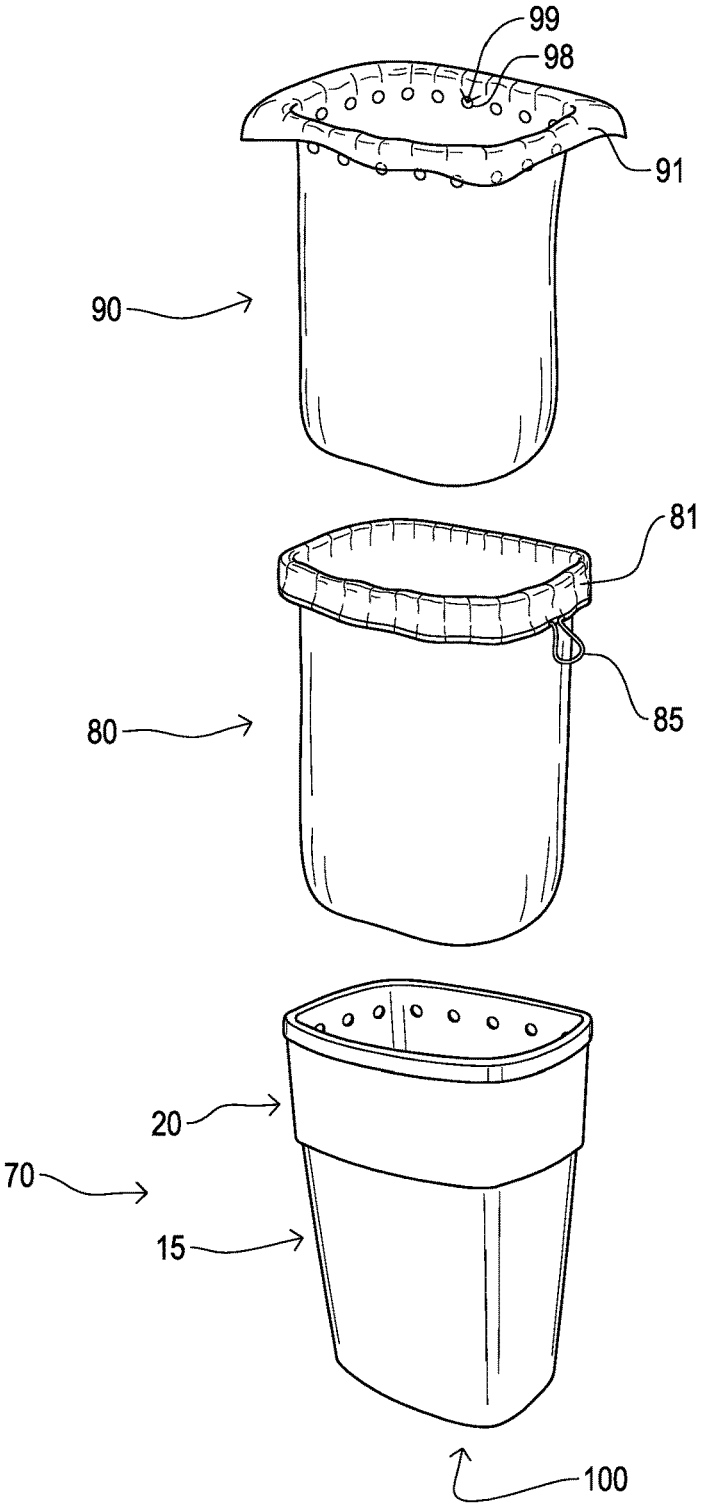
FIG. 7 is an exploded perspective view of the third aspect of the air-ventilated trash container system of the present invention that includes an air-ventilated liner bag that is used with a primary standard trash bag and may be used with the open-top container body of the present invention.

Shown throughout the figures, the present invention is directed toward an air-ventilated trash container system 100 including an open-top hollow container body 50 that accommodates and supports a removable, disposable collapsible trash bag 80 (FIGS. 6-7). In the embodiments, the container body 50 includes air release orifices 19 that allow the trash bag 80 to fully expand during filling of the bag by eliminating unwanted vacuum and air pressure, so the bag very tightly covers the body's inner walls, remaining stable and unmoving, without falling into the trash container. The air release orifices 19 further prevent a vacuum from forming during removal of the trash bag 80. Yet, the air release orifices 19 do not cause irregular structures in the interior of the trash container, which would be difficult to clean around. The container body 50 preferably has a rectangular cross-section, as illustrated, but may take other shapes as are known for trash containers, such as shapes having square, circular, octagonal, and the like cross-sections, or even tapered shapes. Other aspects of the invention provide trash bags to be used with the container body 50 or with standard trash containers.

Figure 1:
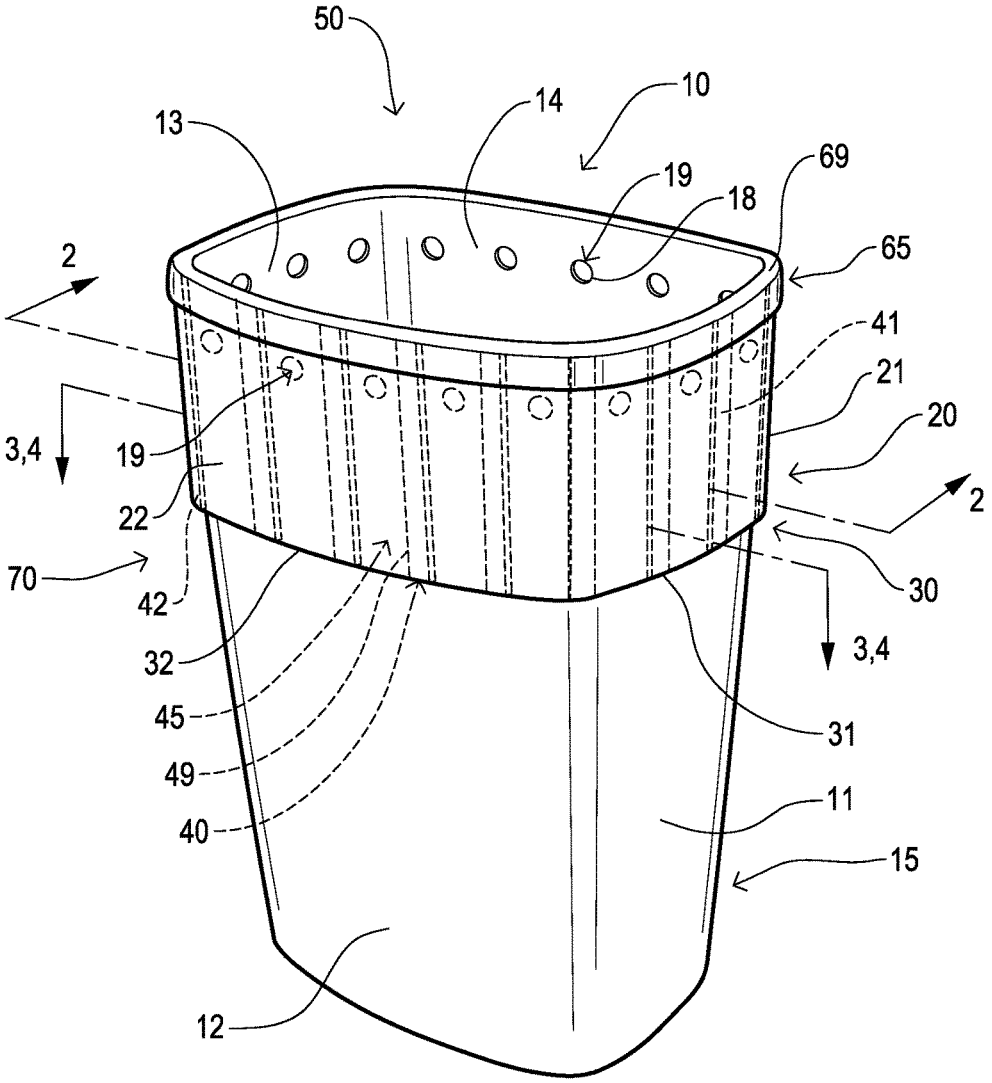
FIG. 1 is a perspective view of the open-top container body of the air-ventilated trash container system of the first embodiment of the present invention showing a primary inner wall, an outer partial wall, ribs extending between the primary inner wall and the outer partial wall, and air release orifices between each of the ribs.
Figure 2:
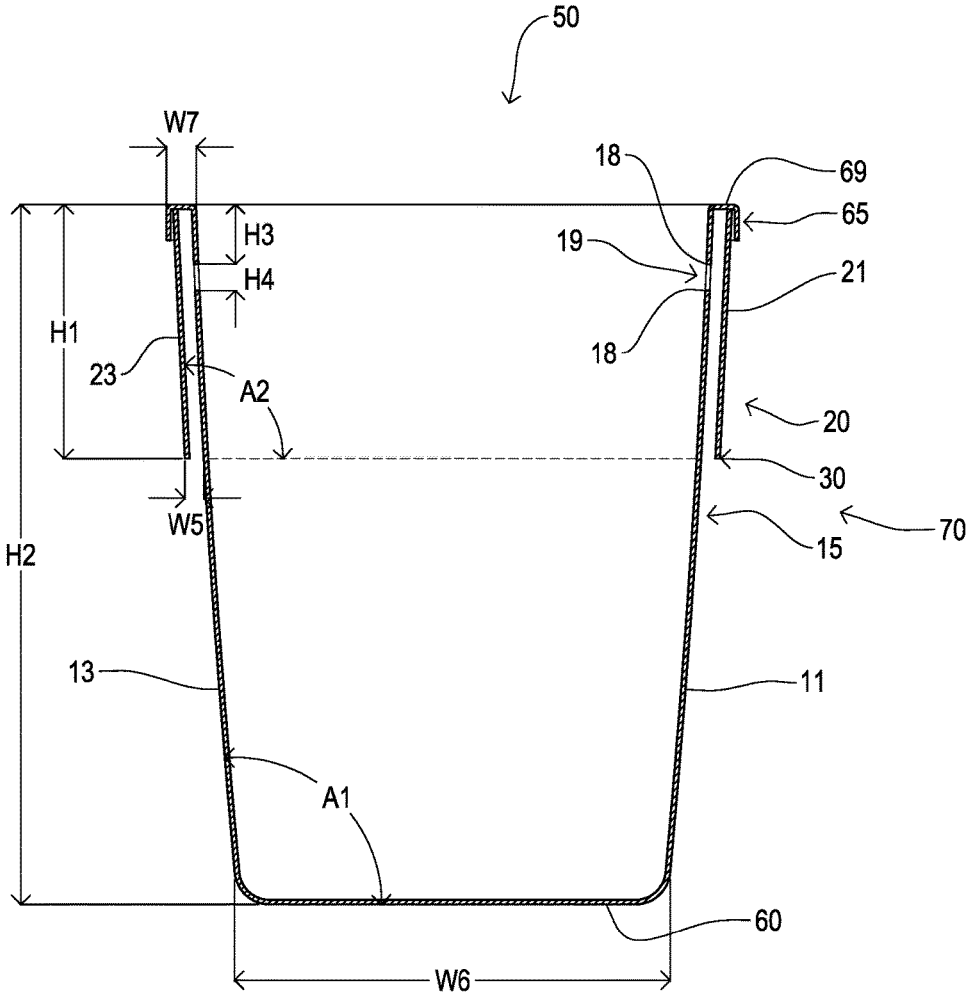
FIG. 2 is a cut view taken along the line 2-2 of FIG. 1 of the open-top container body of the first embodiment of the inventive air-ventilated trash container system.
Figure 5:
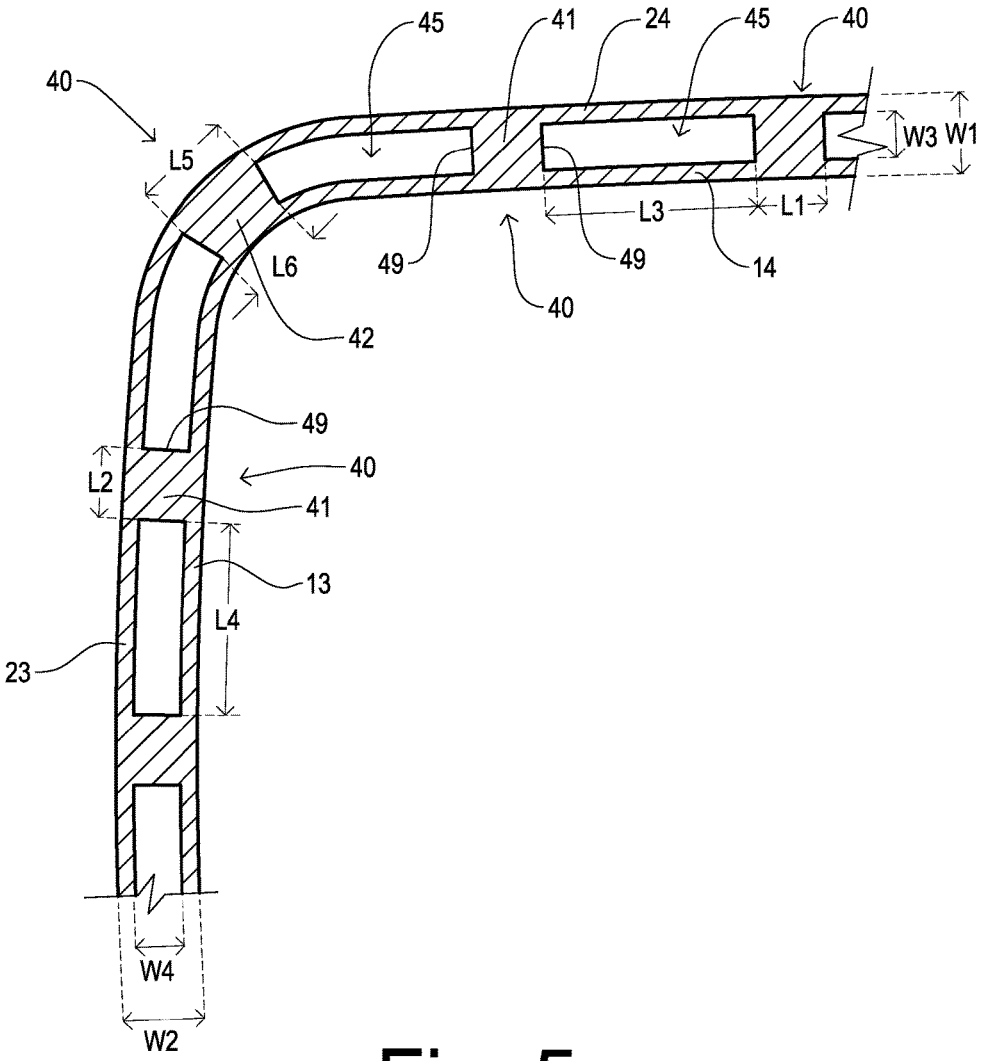
FIG. 5 is detail view taken from circle 5 of FIG. 4 of the open-top container body of the first embodiment of the inventive air-ventilated trash container system.

Referring now to FIG. 1, the open-top hollow container body 50 is illustrated in accordance with a preferred first embodiment of the present invention. In the first embodiment, as shown, the open-top hollow container body 50 may suitably comprise or consist of an integrated sidewall 70 and a bottom wall 60 (FIG. 2). The integrated sidewall 70 may suitably comprise or consist of a primary inner sidewall 15, an outer partial sidewall 20, a top connecting portion 69, and a plurality of support and/or connecting ribs 40 (FIG. 5). The top connecting portion 69 serves to connect the primary inner sidewall 15 and the outer partial sidewall 20 at their respective top edges. When the optional lip 65 is included along the top perimeter of the container body 50 as a portion of the integrated sidewall 70, as shown in FIG. 1, the top connecting portion 69 may further comprise the lip 65.

The primary inner sidewall 15 extends continuously laterally around the interior of the container body 50 having an inner surface that forms the inside of the container body 50 and having an outward surface that is visible below the outer partial sidewall 20. The lower edge of the primary inner sidewall 15 is permanently attached to, and preferably formed integrally with, the bottom wall 60 at a sidewall-bottom intersection. The upper edge of the inner sidewall 15 is permanently attached to, and preferably formed integrally with, the inward portion of the top connecting portion 69 at a primary inner sidewall-inward connecting portion intersection.

The primary inner sidewall 15 comprises inner sidewall portions 11, 12, 13, 14 that are upright or generally vertical in that they may form an angle of from ninety degrees to one hundred and thirty degrees with either the bottom wall 60 or with the floor upon which the trash container rests.

As seen in the cut view of FIG. 2, the primary inner sidewall 15 extends from an inward area of the top connecting portion 69 downward to the bottom wall 60. The height H2 (FIG. 2) of the primary inner sidewall 15, from the top connecting portion 69 to the lower border joined to the bottom wall 60 or to the ground upon which the bottom wall 60 rests, defines the height of the trash container body 50. The width W6 (FIG. 2) defines the width of the trash container body 50. Height H2 and width W6 will vary, based on considerations such as the desired contained volume, the planned type of usage, the location of usage, design aesthetics, standard trash bag shapes and sizes, and the like. However, an exemplary height H2 of a trash container sized to accommodate 13-gallon kitchen trash bags is between 50 and 53 cm, and is most preferably 51.5 cm. An exemplary width W6 of a trash container sized to accommodate 13-gallon kitchen trash bags is between 59 and 61 cm, and is most preferably 60.3 cm. The thickness of the inner sidewall 15 may be between 1 and 8 mm, but is preferably between 1 and 3 mm, and is most preferably 1.5 mm.

The upper portion of the primary inner sidewall 15 is configured with a plurality of laterally spaced apart air release orifices 19 defined by air release orifice edges 18. There is at least one air release orifice 19 between each set of adjacent ribs 40. These air release orifices 19 are disposed at least within the top half of the primary inner sidewall 15, preferably within the top quarter of the primary inner sidewall 15, and most preferably within the top fifteen percent of the primary inner sidewall 15. For example, the distance H3 (from the top connecting portion 69 to the top of a top one of the air release orifice edges 18) in a trash container sized to accommodate 13-gallon kitchen trash bags may be from 3 to 7 cm, but is preferably between 4 and 5 cm, and most preferably is 4.5 cm.

The air release orifices 19 extend from the interior surface to the exterior surface of the inner sidewall 15, thereby providing a route for air trapped between the installed trash bag 80 and the inner wall 15 to escape during the installation of the trash bag 80 and providing a route for air to be drawn into the area between the inner wall 15 and the trash bag 80 when the trash bag is being removed. The air release orifices 19 are preferably circular (as illustrated). However, as the shape does not affect the effectiveness of the air movement, the air release orifices 19 may be formed in any other shape, such as in the shape of ovals, squares, rectangles, pentagons, octagons, and the like, based on considerations such as aesthetics or manufacturing ease. Though the air release orifices 19 of a container body 50 are illustrated as all having the same shape, the air release orifices 19 may also be designed using two or more different shapes. An exemplary distance H4 (from the top edge 18 of an air release orifice 19 to the bottom edge 18 of the air release orifice 19) in a trash container sized to accommodate 13-gallon kitchen trash bags may be from 0.5 to 2 cm, but is preferably between 1 and 2 cm, and most preferably is 1.4 cm.

The outer partial sidewall 20 is exterior to the inner sidewall 15. It extends continuously around the exterior of the top portion of the container body 50 and extends vertically from the top connecting portion 69 to an outer partial sidewall edge 30 (which includes the right outer partial sidewall edge 31 and front outer partial sidewall edge 32, as seen in FIG. 1). The upper edge of the outer partial sidewall 20 is permanently attached to, and preferably formed integrally with, an outer area of the top connecting portion 69 at an outer partial sidewall-outer connecting portion intersection. The outer partial sidewall 20 serves to conceal the air release orifices 19 and channels 45, thus giving the exterior of the trash container body 50 a clean, trim, minimalistic visual impression.

Figure 3:
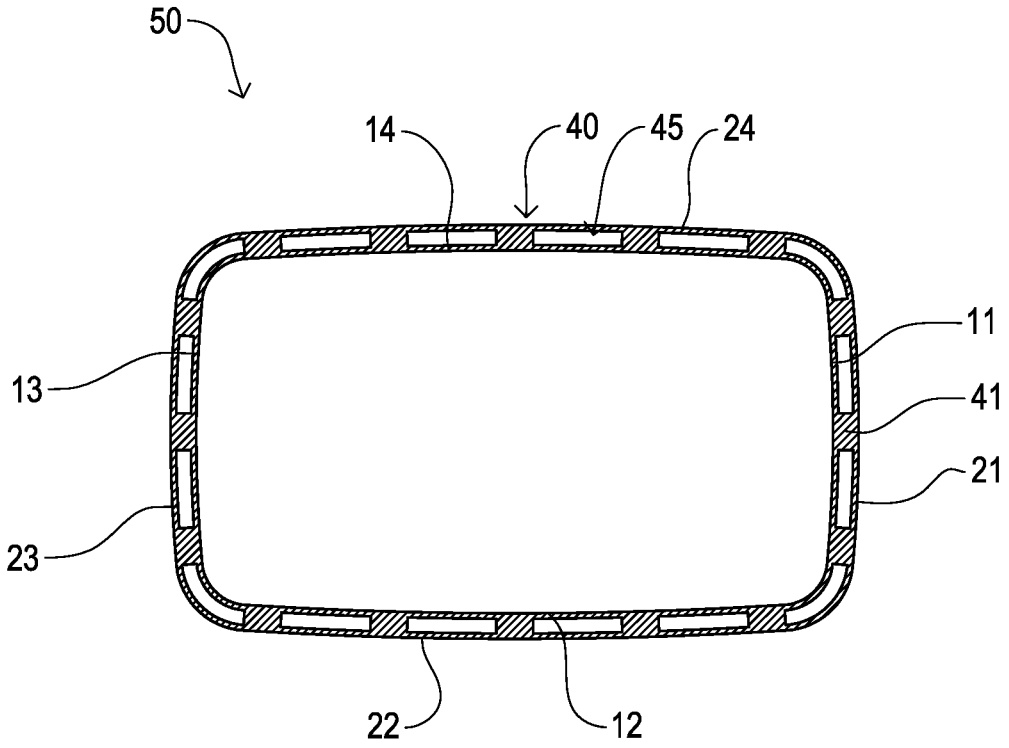
FIG. 3 is cut view taken along the line 3,4-3,4 of FIG. 1 of a first aspect of the first embodiment of the inventive air-ventilated trash container system.

The outer partial sidewall 20 comprises a right outer partial sidewall portion 21, a front outer partial sidewall portion 22, a left outer partial sidewall portion 23 (FIG. 3), and a back outer partial sidewall portion 24 (FIG. 3). The outer partial sidewall portions 21, 22, 23, 24 are upright or generally vertical. These sidewalls form an angle A2 between an imaginary line that is parallel to the floor upon which the bottom wall 60 rests and is at the level of the outer partial sidewall edge 30 and the outer partial sidewall portions 21, 22, 23, 24 of from ninety degrees to one hundred and thirty degrees. Typically, the angle A2 will be equal to the angle A1 of the corresponding inner sidewall portions 11, 12, 13, 14. However, this is not a requirement of the invention, but may be based on design considerations.

The height H1 (FIG. 2) of the secondary outer partial sidewall 20, from the top connecting portion 69 to the outer partial sidewall edge 30, is less than the height H2 of the primary inner sidewall 15. Preferably, the height H1 is less than one-half of the height H2 of the inner sidewall 15. For example, in a trash container body 50 sized to accommodate a 13-gallon kitchen trash bag, the height H1 may be from 5 to 25 cm, but is preferably between 7 and 9 cm, and is most preferably 8.3 cm. In a trash container body 50 sized to accommodate a 13-gallon kitchen trash bag, an exemplary horizontal distance between the outer partial sidewall 20 and the inner sidewall 15 may be between 1 and 5 mm, but is preferably between 2 and 4 mm, and is most preferably 3 mm. The thickness of the outer partial sidewall 20 may be between 1 and 5 mm, but is preferably 1.5 mm.

A plurality of laterally spaced apart support and/or connecting ribs 40 are disposed within the integrated sidewall of the container body 50 between the inner sidewall 15 and the outer partial sidewall 20. The ribs 40 include side ribs 41 and preferably include corner ribs 42. Ribs 40 are preferably formed integrally with the inner and outer sidewalls 15, 20. The ribs 40 define between themselves a plurality of narrow channels 45 that extend longitudinally to provide a passage between the inner sidewall 15 and the outer partial sidewall 20 for the movement of air from the interior of the container body 50 during the placement of the trash bag 80 into the container body 50 and during removal of the trash bag 80 from the container body 50. Preferably, each rib 40 may extend fully from the top connecting portion 69 to the outer partial sidewall edge 30. However, optionally, each rib 40 may extend from the top connecting portion 69 to a location above the outer partial sidewall edge 30 or may extend from a location below the top connecting portion 69 to a location above the outer partial sidewall edge 30. Optionally, though the ribs 40 are shown as extending an equal distance approximately equal to height H1, this is not necessary to the invention, and individual ribs 40 may not extend an equal distance.

Figure 4:
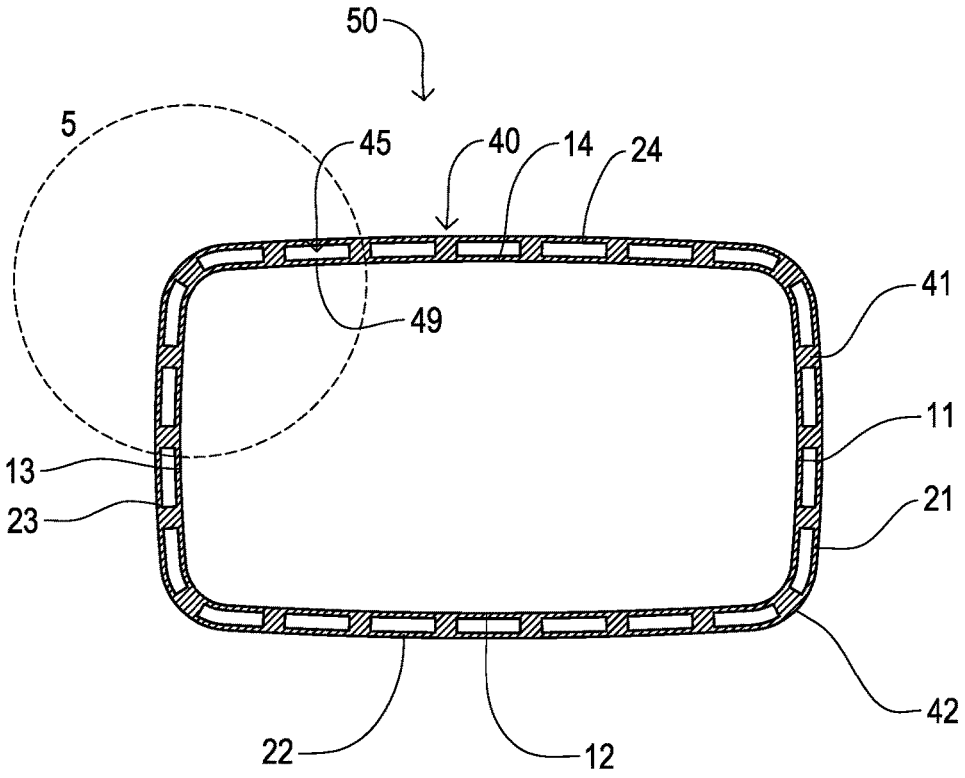
FIG. 4 is cut view taken along the line 3,4-3,4 of FIG. 1 of a preferred second aspect of the first embodiment of the inventive air-ventilated trash container system.

As seen in FIG. 1, the air release orifices 19 defined by air release orifice edges 18 are disposed in channels 45 between the ribs 40 within the primary inner sidewall 15. Thus, during installation of a trash bag 80 into the container body 50, air trapped between a trash bag 80 and the inner surface of primary inner sidewall 15 can move as follows: (1.) from the interior side of the primary inner sidewall 15; (2.) through an air release orifice 19 to the exterior side of the primary inner sidewall 15; (3.) into a channel 45 (FIG. 4); (4.) down the channel 45 to the open bottom of the channel 45; and (5.) out of the trash container system and into the open air by passing edge 30 of the outer partial sidewall 20.

A variety of widths and spacings of the ribs 40 and channels 45 are within the scope of the invention. FIGS. 3 and 4 demonstrate two of the many possible variations in widths, placement, and spacing.

In FIG. 3, a channel 45 is located at each of the corners of the open-top container body 50. Therefore, in FIG. 3, the ribs 40 are all side ribs 41. However, preferably, as seen in FIG. 4, ribs 40 include both side ribs 41 and corner ribs 42. In FIG. 4, a corner rib 42 is located at each of the corners of the open-top container body 50 to increase the strength of the corners and to add to the robustness and serviceability of the container body 50.

As seen in the detail view of FIG. 5 (not to scale), exemplary dimensions for a trash container sized to accommodate 13-gallon kitchen trash bags may be as follows: (1.) L1 (the length of a side rib 41 of a first side between edges 49) may be between 1 and 50 mm, but is preferably between 2 and 4 mm, and is most preferably 3 mm; (2.) L2 (the length of a side rib 41 of a second side between edges 49) may be equal to L1 or not, but is between 1 and 50 mm, and preferably between 2 and 4 mm, and is most preferably 3 mm; (3.) L3 (the length of a channel of a first side) may be between 1 and 10 cm, but is preferably between 4 and 8 cm; (4.) L4 (the length of a channel of a second side) may be equal to L3 or may be within the dimensions stated for L3; (5.) L5 (the exterior width of a corner rib 42) may be between 1 and 50 mm, but is preferably between 2 and 4 mm, and is most preferably 3 mm; (6.) L6 (the interior length of a corner rib 42) may be equal to L5, but would typically be smaller than L5, but in any case, is between the dimensions stated for L5; (7.) W1 (the distance between the inner edge of the inner sidewall 14 and the outer edge of the outer partial sidewall 24 of a first side of the open-top container body 50) may be between 3 and 10 mm, but is preferably between 4 and 8 mm, and is most preferably 6 mm; (8.) W2 (the distance between the inner edge of the inner sidewall 13 and the outer edge of the outer partial sidewall 23 of a second side of the open-top container body 50) may be equal to W1 or not, but is within the dimensions stated for W2; (9.) W3 (the width of a channel which is the distance between the outer edge of the inner sidewall 14 and the inner edge of the outer partial sidewall 24 of a first side) may be between 1 and 50 mm, but is preferably between 2 and 4 mm, and is most preferably 3 mm; (10.) W4 (the width of a channel which is the distance between the outer edge of the inner sidewall 13 and the inner edge of the outer partial sidewall 23 of a second side) may be equal to W3 or not, but is within the dimensions stated for W3.

The distance or gap between the primary inner sidewall 15 and the outer partial sidewall 20 may be between 2 and 10 mm, but is preferably 3 mm. This gap need not be consistent from the upper portion of the outer partial sidewall 20 to the lower portion of the outer partial sidewall 20. For example, the width W3, W4 of the gap at the top may be 3 mm, but the width W5 of the gap at the bottom near outer partial sidewall edge 30 may be 1 mm, to facilitate stacking for shipping and storage.

The container body 50 is manufactured in a conventional manner, preferably formed unitarily of a durable plastic polymer by a standard molding technique, such as by injection molding. The plastic polymer used may be any standard polymer that resists dents and cracks and does not rust, chip or peel. For example, polypropylene may be used in the manufacturing process. Alternatively, the container body 50 may be manufactured using metal in a conventional manner by standard techniques.

Preferably the container body 50 is formed with rounded corners for easy cleaning. The container body 50 can be formed in various dimensions and colors. A typical volume of the container body 50 is from 1 to 50 gallons. Optionally, the trash container system may further comprise a lid (not shown) that may be used with the container body 50. The lid may be a flat lid, hooded lid, swing lid, or any other conventional lid, as is known in the art. The lid is typically designed to fit onto the top of the container body 50.

To use the air-ventilated trash container system 100 of the present invention, the user introduces a disposable collapsible trash bag 80 (FIGS. 6-7) into the open-top hollow container body 50. Optionally, the user may push the trash bag 80 against the inner walls of the primary inner sidewall 15, or the user may allow any inserted trash to push the trash bag 80 against the inner walls of the primary inner sidewall 15. The interior force on the trash bag 80 causes the air trapped between the inner sidewall 15 and the trash bag 80 to move through one or more of the air release orifices 19, into the channels 45, and out into the open air. This allows the trash bag 80 to extend to the full volume of the container body 50, which enables a full volume of trash to be placed within the trash bag 80. When removing the trash bag 80, the air can move in the opposite direction to prevent any vacuum formation between the inner sidewall 15 and the trash bag 80. This facilitates removal of the trash bag 80 and the contained trash from the container body 50.

FIGS. 6-7 are perspective views of a third aspect of the air-ventilated trash container system 100 of the present invention that includes an air-ventilated liner bag 90 used with a standard trash bag 80. The standard trash bag 80 may be a drawstring bag with a drawstring 85, such as is illustrated, or may be a non-drawstring bag. The size of the standard trash bag 80 and the size of the air-ventilated liner bag 90 selected for use corresponds to the size of the open-top container body 50. The air-ventilated liner bag 90 is configured with air holes 99 defined by air hole edges 98. The air holes 99 are disposed within the top twenty-five percent of the ventilated liner bag 90 and are preferably disposed within the top fifteen percent.

The air holes 99 extend through the air-ventilated liner bag 90 to provide a route for movement of air between the installed trash bag 80 and air-ventilated liner bag 90. As seen in the exploded view of FIG. 7, the standard trash bag 80 is first inserted within the trash container body 50 and the top edge is typically lapped over the outside of the container body 50. The inner air-ventilated liner bag 90 is then placed within the standard trash bag 80. Any air trapped between the first-installed trash bag 80 and the second-installed trash bag 90 is able to escape through air holes 99.

The standard trash bag 80 and the air-ventilated liner bag 90 typically would be formed of a linear low density (LLD) plastic material that is resistant to puncturing. Optionally, the standard trash bag 80 and the air-ventilated liner bag 90 could be formed of low density or high density plastic. The thickness or gauge of the standard trash bag 80 can vary from 0.5 Mil up to 4.0 Mil, but will typically be from 0.7 to 2 Mil. The gauge of the inner air-ventilated liner bag 90 will typically be equal to the gauge of the standard trash bag 80, but this is not a requirement of the invention. For example, the inner bag 90 may be of a thinner gauge with the strength of the two-bag system resulting substantially from the thickness of the outer bag 80.

The two-bag combination of the air-ventilated liner bag 90 with a standard trash bag 80 provides versatility as well as providing an extra measure of strength and durability, when needed. For instance, in situations in which the air-ventilated liner bag 90 is installed within the standard trash bag 80 inside the container body 50, if the user has discarded a few light boxes that fill the container body 50, he or she may simply remove only the inner air-ventilated liner bag 90, tie the top, and discard the second-installed ventilated liner bag 90 with the contained trash. However, if the user discards garbage that is heavier or likely to puncture, the user can pick up both the inner air-ventilated liner bag 90 together with the outer standard trash bag 80. This allows the user, at will, to use a double bag when the situation warrants or to use a single bag for light or non-messy trash.

Another exemplary use for the air-ventilated liner bag 90 is as a barrier bag to obstruct vapors that may be emitted by trash contained within a standard trash bag 80 or contained within an air-ventilated liner bag 90 that is installed within a standard trash bag 80. For example, a trash can may have only a small amount of trash held within an interior bag, but the trash may be odiferous and unpleasant. If a user does not want to empty the almost empty bag, an air-ventilated liner bag 90 may be dropped into the container body over the contained trash, with the upper edges pulled over the top periphery and slightly down the exterior sides of the container body. With gentle manual pressure, the liner bag 90 can be positioned over the contained trash, with the air trapped between the inner bag and the newly installed liner bag 90 allowed to escape through the air holes 99. Thus, the air-ventilated trash bag 90 can serve as a barrier to smells as it forms a partial seal over the trash beneath it.

Though the air holes 99 are shown as all having the same circular shape, because the shape does not affect the effectiveness of the movement of the air from between the trash bag 80 and the ventilated liner bag 90, they may be formed in any shape or multiple shapes, based on considerations of aesthetic design, strength of the ventilated liner bag 90, economics, ease of manufacturing, consumer preferences, and the like.

Figure 8:
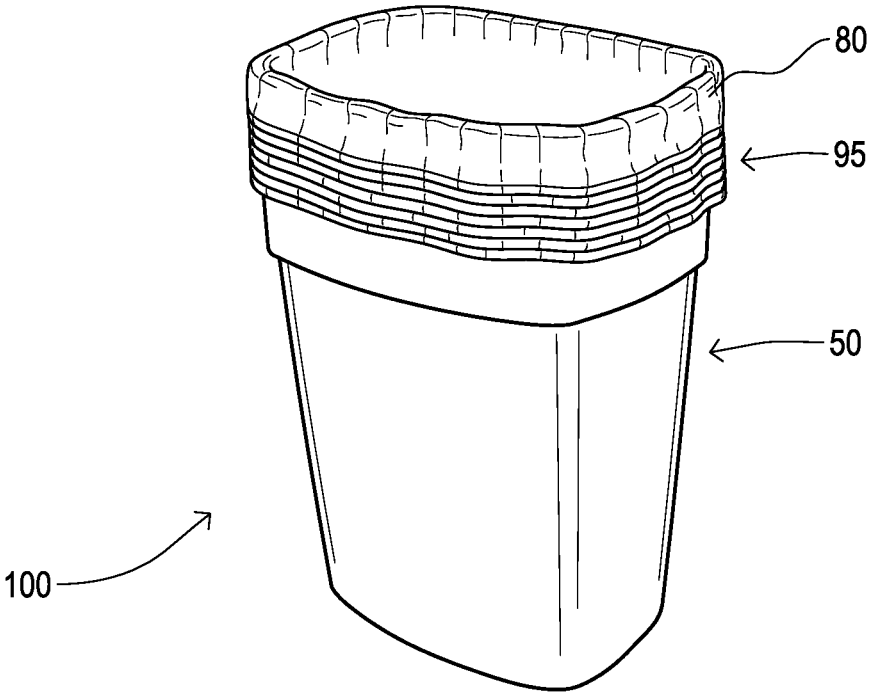
FIG. 8 is a perspective view of a fourth aspect of the air-ventilated trash container system of the present invention that includes a tightly-packed assemblage of multiple nested trash bags that are accommodated within the container body.

FIG. 8 is a perspective view of a fourth aspect 100 of the air-ventilated trash container system 100 of the present invention that includes a set 95 of nested standard trash bags 80. The nested set 95 of standard trash bags 80 may be a drawstring-type bags, but are preferably non-drawstring bags. They are packaged and sold in a tightly nested set 95. To use the nested set 95, the entire nested set 95 is placed into the container body 50, and the tops are folded down over the top of the container body 50. When the inner-most one of the standard trash bags 80 of the nested set 95 is filled, the inner-most trash bag 80, is peeled upward with the internal trash enclosed. The second one of the trash bags 80 is then used in a similar manner, and so on and so forth. Because each new bag is not individually installed, the usage of nested bags is efficient and saves both time and effort. Preferably, the set of nested trash bag set 95 includes from 3 to 40 individual standard trash bags 80.

In this fourth aspect, if a large number of trash bags 80 (such as over 10, and preferably about 30) are to be nested for installation, the container body 50 to be used with this larger number of nested bags 80 may be made with a slightly smaller width, smaller length, or smaller width and length to allow convenient installation of the nested set 95 over the top of the container body 50. Also, optionally, the container body 50 may be formed with a slightly lesser height H2 than the conventional container body 50 for the particular size of trash bags. The height H2 may be, for example, 1.5 to 2.5 inches shorter to allow a sufficient amount of the top of the nested set 95 to be positioned over the top of the container body 50. These modifications may be advantageous because a smaller outer perimeter of the top of the container body 50 will allow the nested trash bags 80 to be easily placed over the top of the body 50, even though multiple nested bags do not exhibit a large degree of expansion. Additionally, the reduction in height is desirable to allow the multiple nested trash bags 80 to sufficiently extend over the top of the container body 50 for securing.

Figure 9:
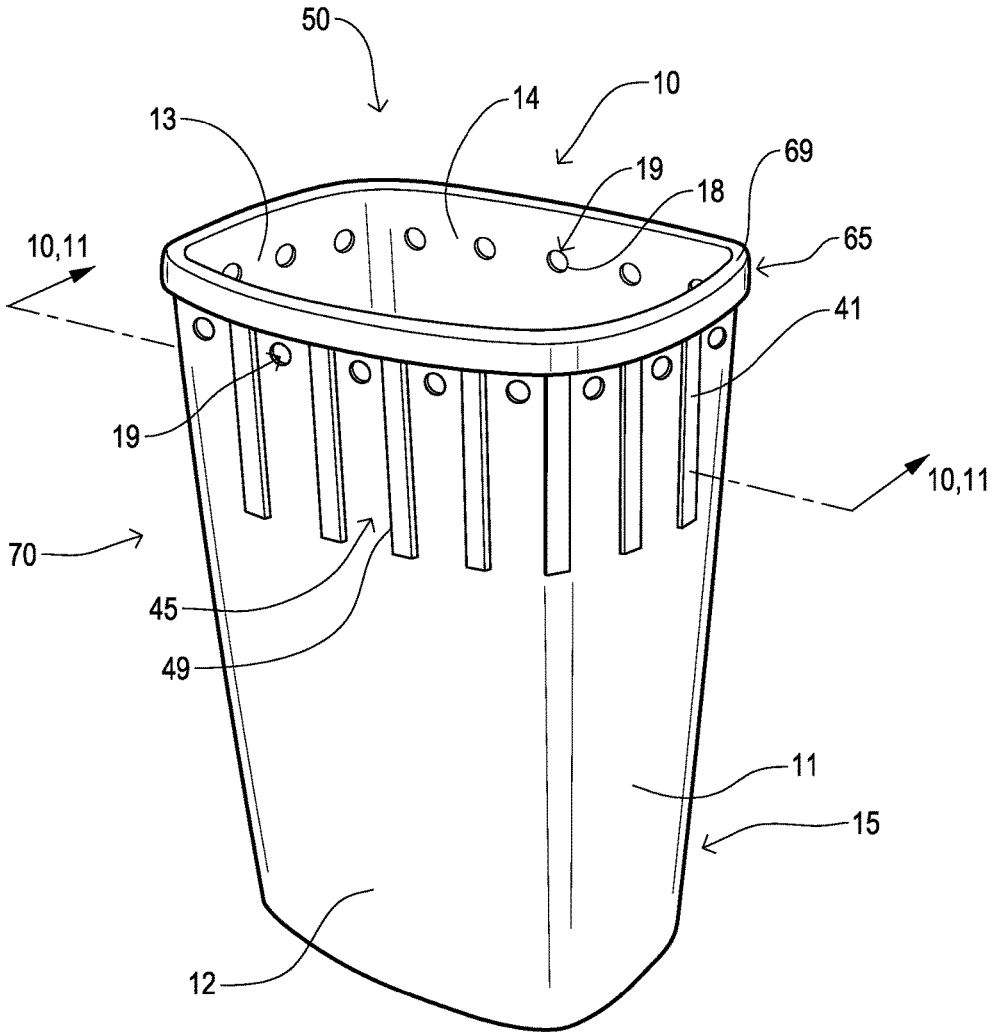
FIG. 9 is a perspective view of the open-top container body of the air-ventilated trash container system of the second embodiment of the present invention showing an inner wall with external ribs and air release orifices interspersed between the ribs that does not include an outer, partial wall.
Figure 10:
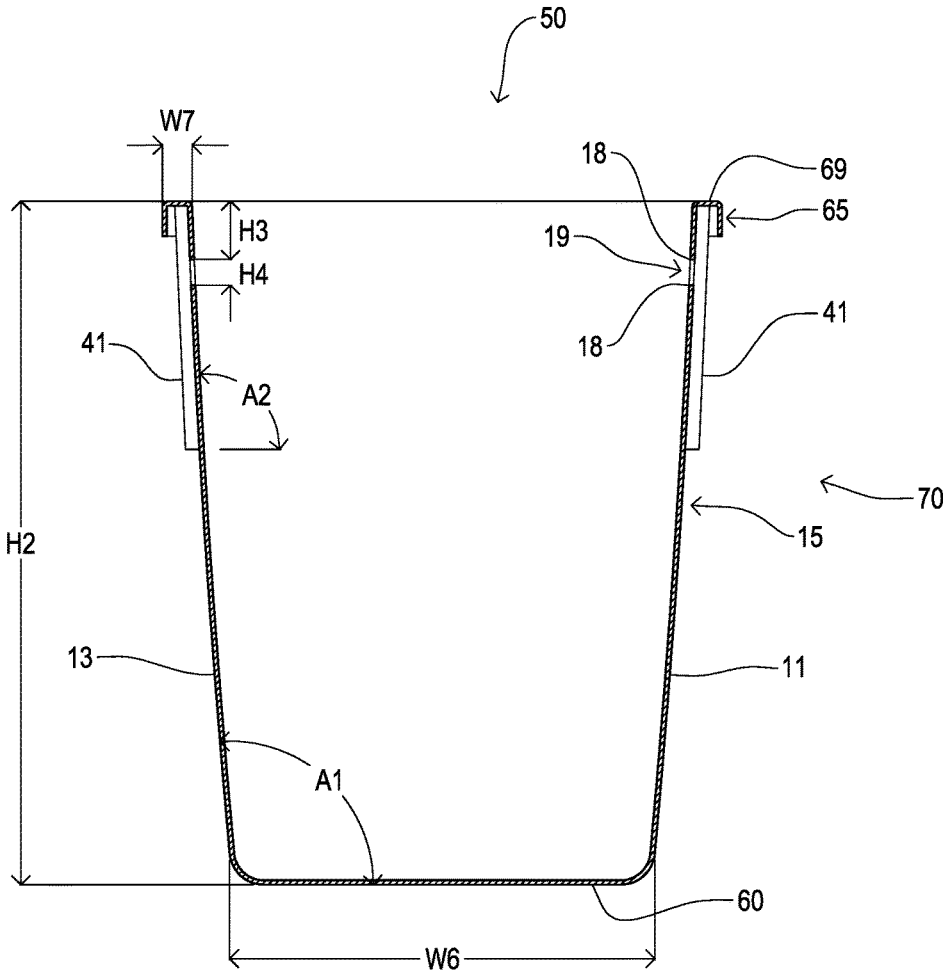
FIG. 10 is a cut view taken along the line 10, 11-10, 11 of FIG. 9 of the open-top container body of the second embodiment of the inventive air-ventilated trash container system.

FIGS. 9-10 show the second embodiment of the open-top container body of the air-ventilated trash container system of the present invention. The second embodiment is similar to the first embodiment, but varies in that the outer partial wall 20 of the first embodiment is omitted. In the second embodiment the open-top hollow container body 50 includes the primary inner sidewall 15, a top connecting portion 69, and a plurality of support and/or connecting ribs 40, as in the first embodiment, but does not include the outer partial sidewall 20. Thus, the air release orifices 19 extend through the inner sidewall 15 and the ribs 40 extend outwardly from the primary inner sidewall 15, as in the first embodiment, but neither the air release orifices 19 nor the ribs 40 are concealed. In other aspects, the second embodiment correlates to the first embodiment.

Figure 11:
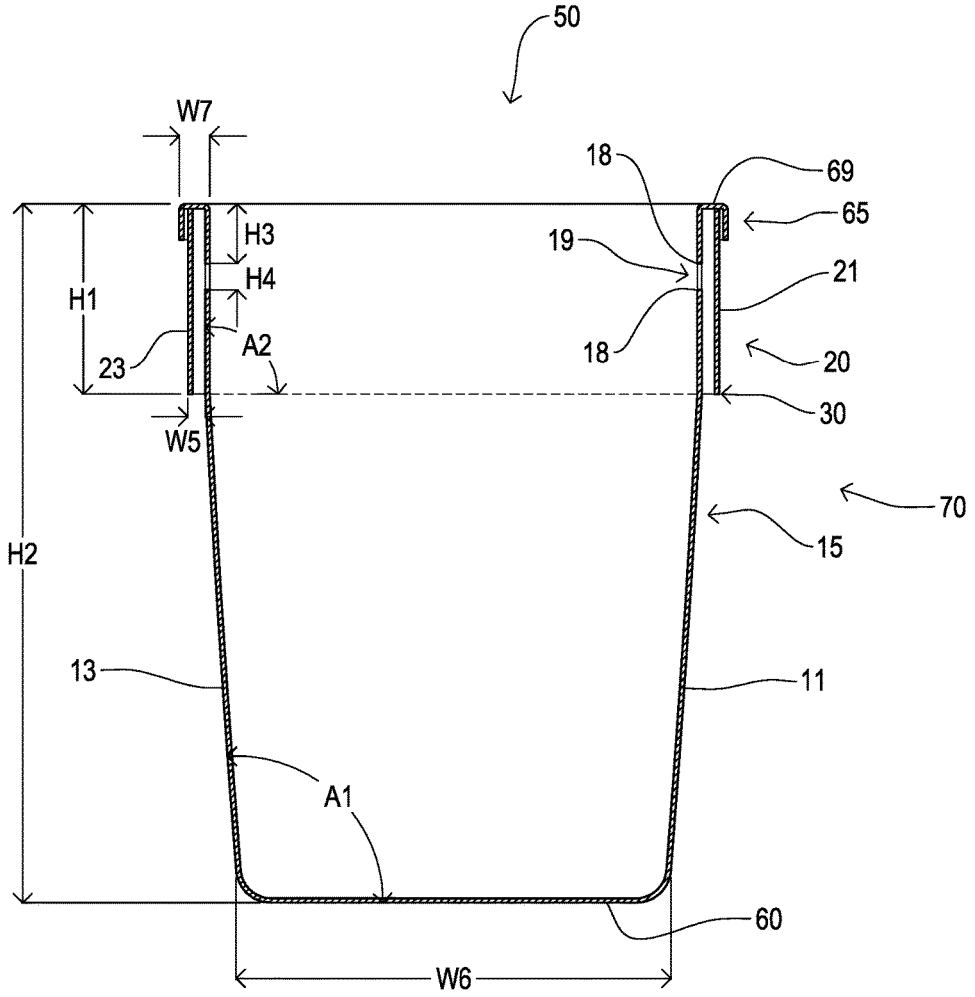
FIG. 11 is a cut view taken along the line 10, 11-10, 11 of FIG. 9 of the open-top container body of a third embodiment of the inventive air-ventilated trash container system.

FIG. 11 shows a third embodiment of the open-top container body 50 of the air-ventilated trash container system of the present invention. The third embodiment is similar to the first embodiment, but varies in that the outer partial wall 20 and the upper portion of the primary inner sidewall 15 are perpendicular to the floor instead of angled, as opposed to the angle shown in the first embodiment. Specifically, the angle of all or part of the inner sidewall 15 need not be uniform from top to bottom, and the angle formed between all or part of the inner sidewall 15 and the floor upon which the bottom wall 60 rests can be from 60 to 120 degrees. (This angle is shown as 90 degrees in FIG. 11 and as about 95 degrees in FIG. 2.) Similarly, in the embodiments which have an outer partial sidewall 20, the angle of all or part of the outer partial sidewall 20 need not be uniform from top to bottom, need not follow the angle of the inner sidewall 15, and the angle formed with the floor may vary from 60 to 120 degrees.

Figure 12:
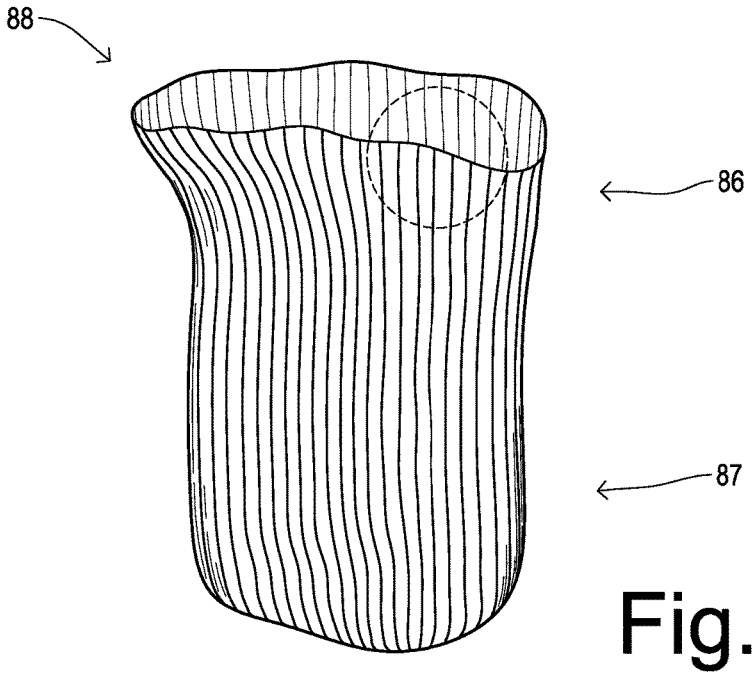
FIG. 12 is a perspective view of a fifth aspect of the air-ventilated trash container system of the present invention that provides a first external projection-type trash bag that is accommodated within the container body.
Figure 13:
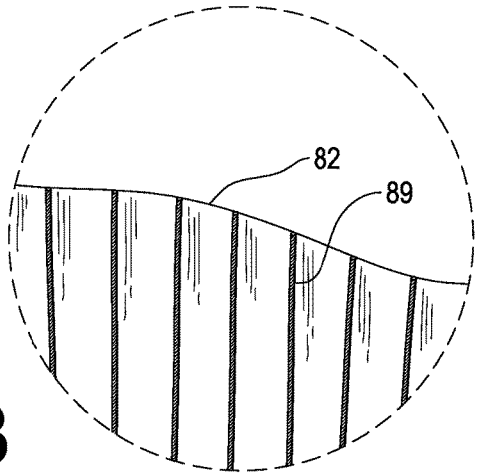
FIG. 13 is a detail view taken from oval 13 of FIG. 12.
Figure 14:
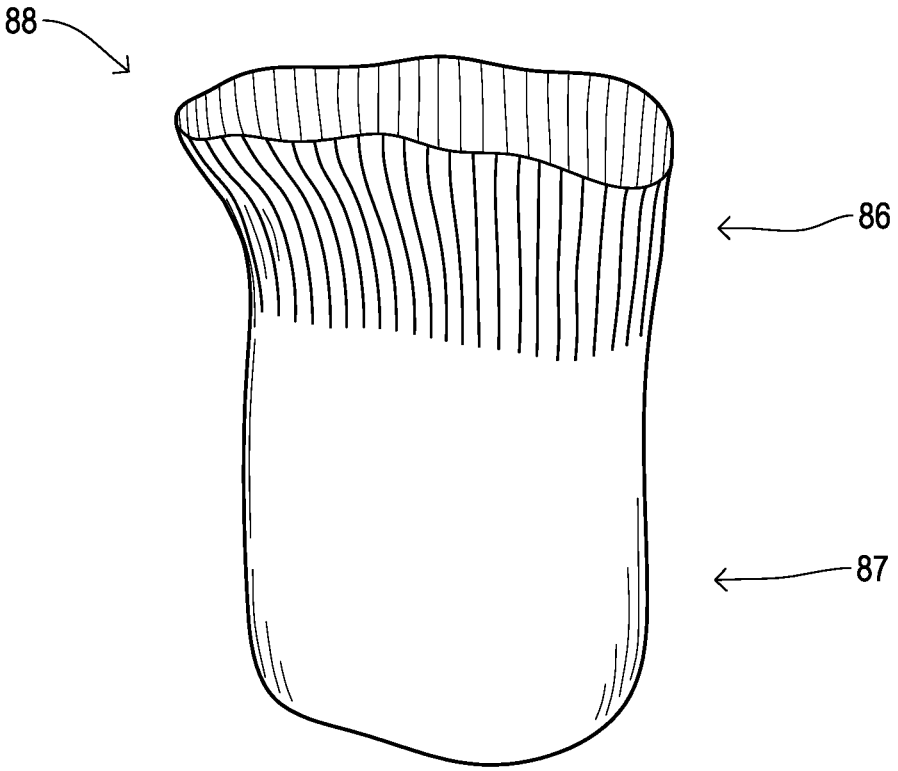
FIG. 14 is a perspective view of a sixth aspect of the air-ventilated trash container system of the present invention that provides a second external projection-type trash bag that is accommodated within the container body.

FIGS. 12-14 illustrate an external projection-type trash bag 88 having protruding irregularities 89 on the non-uniform exterior surface of the plastic sheeting material forming the trash bag. This external projection-type trash bag 88 can be accommodated within the open-top container body 50 or can be used with a standard trash can body. The exterior surface of the plastic bag material is non-uniform with the protruding irregularities 89 serving to create air space between the exterior of the external projection-type trash bag 88 and the lip of the trash can body. When the bag 88 is inserted into the trash container body, the upper portion is slightly stretched over the top lip of the container body. Without the protruding irregularities 89, a bag will adhere tightly to the top lip, preventing the escape of air. The protruding irregularities 89 prevent this tight adherence and allow the trapped air between the trash bag and the inner wall of the container body to find pathways over the lip and down to the open air.

In the illustrations, the protruding irregularities 89 are shown as parallel bulges or raised lines, but they need not be uniform. The protruding irregularities 89 may be formed integrally with the plastic sheeting material or may be formed separately and applied to the exterior of the plastic sheeting material as the bags are manufactured. For instance, the plastic sheeting material may be pinched, crinkled, scrunched, folded, rumpled, or creased as it is manufactured to create the protruding irregularities 89. Or, optionally, a separate fiber, cord, line, or filament may be created of the same type of plastic sheeting material or of a different material and may then be adhered onto the exterior surface of the bag 88.

FIG. 12 illustrates a first external projection-type trash bag 88 in which the protruding irregularities 89 are shown as filaments that are encased within or attached to the plastic sheeting material of the bag 88. The protruding irregularities 89 extend fully longitudinally from the top edge 82 of the upper portion 86 of the bag to the seam at the end of the lower portion 87 of the bag.

Alternatively, protruding irregularities 89 may be disposed only on the top portion 86 of the bag, as seen in the second external projection-type trash bag 88 shown in FIG. 14. In this case, the protruding irregularities 89 extend from the top edge 82 to a point above the middle of the bag 88.

The external projection-type trash bag 88 typically would be formed of a sheeting material formed of linear low density (LLD) plastic material that is resistant to puncturing, but may optionally be formed of low density or high density plastic. The thickness or gauge of the corded bag 88 can vary from 0.5 Mil up to 4.0 Mil, but will typically be from 0.7 to 2 Mil.

The provided open-top hollow container body 50 herein presented is economical to manufacture unitarily, is stackable for shipping, can be sized and designed for use with any standard size of trash bag, and has no interior irregular structure that can collect dirt and be difficult to clean, but has a smooth, easy-cleaning interior surface. The outer partial sidewall 20 prevents viewing of the air release orifices 19 and, in combination with the lower portion of the inner sidewall 15, presents a visually smooth exterior, which is easy to clean. Yet the inclusion of the air release orifices 19 and channels 45 allows the removable trash bag 80 to accommodate a full volume of trash.

Due to the air release orifices 19 in cooperation with channels 45, air trapped between the trash bag 80 and the inner walls of the container body 50 is easily expelled, thus eliminating the air pressure and vacuum problems of conventional trash can systems. In conventional trash can systems, this air pressure makes it difficult to force the trash bag down into the container body 50 when installing a bag and will not let the trash bag fully fill. Additionally, in conventional trash can systems, the vacuum created by the air pressure between the full trash bag and the inner walls of the trash can will frustrate the user in the removal of the full trash bag. In the instant invention, these problems are eliminated. When inserted, the empty trash bag 80 easily fills out fully against the inner walls of the container body 50. During removal of the full trash bag 80, no vacuum is created between the bag 80 and the inner walls or bottom wall of the container body 50, thus allowing easy removal.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A trash container system comprising:

an open-top hollow container body having a top perimeter comprising:

an integrated sidewall and a bottom wall formed integrally with said integrated sidewall;

wherein said integrated sidewall comprises:

a continuous upright inner sidewall having an upper portion and a lower portion, having a height H2 from said upper portion to said lower portion, and having a plurality of upper air release orifices disposed within said upper portion of said inner sidewall;

a top connecting portion disposed at said top perimeter of said open-top container body;

a continuous outer partial sidewall that extends downward from said top connecting portion and that has a height H1 that is less than half of said height H2;

a plurality of laterally spaced apart, generally vertical ribs disposed between said exterior of said inner sidewall and said outer partial sidewall;

a right inner sidewall portion;

a front inner sidewall portion, wherein a first corner is formed between said right inner sidewall portion and said front inner sidewall portion;

a left inner sidewall portion, wherein a second corner is formed between said front inner sidewall portion and said left inner sidewall portion; and a back inner sidewall portion, wherein a third corner is formed between said left inner sidewall portion and said back inner sidewall portion, and wherein a fourth corner is formed between said back inner sidewall portion and said right inner sidewall portion;

wherein at least one of said plurality of upper air release orifices is disposed between each set of adjacent ones of said generally vertical ribs;

wherein one of said generally vertical ribs is disposed at said first corner;

wherein one of said generally vertical ribs is disposed at said second corner;

wherein one of said generally vertical ribs is disposed at said third corner; and wherein one of said generally vertical ribs is disposed at said fourth corner.

2. The trash container system as recited in claim 1, wherein multiples ones of said plurality of upper air release orifices are disposed between each set of adjacent ones of said generally vertical ribs.

3. The trash container system as recited in claim 1, wherein:

each of said ribs has a length L1, L2 that is between 1 mm and 50 mm; and each set of adjacent ones of said ribs has a distance L3, L4 between said set of adjacent ones of said ribs that forms a channel having a length of between 1 cm and 10 cm.

4. The trash container system as recited in claim 1, wherein:

said trash container system further comprises a standard trash bag and an air-ventilated liner bag;

said air-ventilated bag includes an upper portion and a lower portion;

said air-ventilated bag is formed of an air-ventilated bag plastic sheeting material; and said upper portion of said air-ventilated bag is configured with bag holes extending through said air-ventilated bag plastic sheeting material that are defined by bag hole edges.

5. The trash container system as recited in claim 1, wherein said trash container system further comprises a set of nested trash bags including more than three trash bags.

6. The trash container system as recited in claim 1, wherein said trash container system further comprises an external projection-type trash bag having a smooth interior surface and an exterior surface with protruding irregularities disposed on said exterior surface.

7. The trash container system as recited in claim 1, wherein said bottom wall and said integrated sidewall are formed as a single integral unit.

* * * * *